US010388478B2

(12) United States Patent
Nishimura et al.

(10) Patent No.: US 10,388,478 B2
(45) Date of Patent: Aug. 20, 2019

(54) ELECTROMAGNETIC RELAY FOR SIMPLIFYING ATTACHMENT OF A COUNTERPART MEMBER

(71) Applicant: Panasonic Intellectual Property Management Co., Ltd., Osaka (JP)

(72) Inventors: Tsukasa Nishimura, Hokkaido (JP); Ryosuke Koeda, Mie (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 53 days.

(21) Appl. No.: 15/026,434

(22) PCT Filed: Oct. 3, 2014

(86) PCT No.: PCT/JP2014/005060
§ 371 (c)(1),
(2) Date: Mar. 31, 2016

(87) PCT Pub. No.: WO2015/049880
PCT Pub. Date: Apr. 9, 2015

(65) Prior Publication Data

US 2016/0254113 A1 Sep. 1, 2016

(30) Foreign Application Priority Data

Oct. 4, 2013 (JP) ..... 2013-208895

(51) Int. Cl.
*H01H 50/14* (2006.01)
*H01H 50/02* (2006.01)

(52) U.S. Cl.
CPC ..... *H01H 50/14* (2013.01); *H01H 50/02* (2013.01)

(58) Field of Classification Search
CPC ..... H01H 50/02; H01H 50/14
(Continued)

(56) References Cited

U.S. PATENT DOCUMENTS

2005/0190024 A1* 9/2005 McMahon ..... H01H 1/5855 335/126
2012/0264007 A1* 10/2012 Sasaki ..... H01M 2/043 429/182

(Continued)

FOREIGN PATENT DOCUMENTS

JP 04-027571 U 3/1992
JP 04-030306 U 3/1992

(Continued)

OTHER PUBLICATIONS

International Search Report issued in Application N. PCT/JP2014/005060 dated Jan. 6, 2016, with English translation.

*Primary Examiner* — Bernard Rojas
(74) *Attorney, Agent, or Firm* — McDermott Will & Emery LLP

(57) ABSTRACT

An electromagnetic relay includes a contact device including a fixed terminal with a fixed contact formed, and a movable contactor with a movable contact formed to come into contact with and separate from the fixed contact. The contact device is stored in a housing. The electromagnetic relay further includes a terminal portion including a first terminal portion having a screw portion formed thereon, and a second terminal portion connected to the first terminal portion. The first terminal portion and the second terminal portion are configured to be electrically connected to each other at least in a state where a counterpart member connected to the terminal portion. A rotation restriction portion for restricting relative rotation between the first terminal portion and the second terminal portion is provided on at least one of the first terminal portion or the second terminal portion.

6 Claims, 11 Drawing Sheets

(58) Field of Classification Search
USPC ..... 335/202, 278
See application file for complete search history.

(56) References Cited

U.S. PATENT DOCUMENTS

| | | | | |
|---|---|---|---|---|
| 2013/0033344 | A1 | 2/2013 | Morimura | |
| 2014/0335743 | A1* | 11/2014 | Kakimi | H01R 4/30 439/781 |
| 2016/0226054 | A1* | 8/2016 | Kusama | H01M 2/1072 |

FOREIGN PATENT DOCUMENTS

| | | | |
|---|---|---|---|
| JP | 2009-301874 | A | 12/2009 |
| JP | 2013-037775 | A | 2/2013 |

* cited by examiner (a)
(b)
(c)
100
5
9
7
20
73
81d
80
81a
81c
81
81c
81
80
73
81c
81
80
81c
81
81
20
20
7
100
5
9
7
20
73
81c
81
80
81c
81
80
81c
81

ELECTROMAGNETIC RELAY FOR SIMPLIFYING ATTACHMENT OF A COUNTERPART MEMBER

RELATED APPLICATIONS

This application is the U.S. National Phase under 35 U.S.C. § 371 of International Application No. PCT/JP2014/005060, filed on Oct. 3, 2014, which in turn claims the benefit of Japanese Application No. 2013-208895, filed on Oct. 4, 2013, the disclosures of which are incorporated by reference herein.

TECHNICAL FIELD

The present invention relates to an electromagnetic relay.

BACKGROUND ART

There has heretofore been proposed a technique to facilitate attachment of a counterpart member by using a bolt and the like.

In Patent Literature 1, for example, a bus bar as a counterpart member is connected to a metal terminal having a base fixed to a cell module main body and a tip disposed at a predetermined distance from the cell module main body. Here, a nut is disposed between the tip of the metal terminal and the cell module main body, and the nut comes in contact with a rotation stopper. Thus, slipping rotation of the nut in the connection process of the bus bar is suppressed.

CITATION LIST

Patent Literature

Patent Literature 1: Japanese Patent Application Publication No. 2009-301874

SUMMARY OF INVENTION

Technical Problem

However, in the conventional technique described above, the nut is disposed in the rotation stopper attached on the cell module main body side and a bolt is fastened to the nut, thereby attaching the counterpart member to the metal terminal. As described above, in the conventional technique, the nut is disposed in the rotation stopper after the rotation stopper is attached to the cell module main body, and the bolt is fastened to the nut in this state to attach the counterpart member to the metal terminal. Thus, the process is complicated.

Therefore, it is an object of the present invention to obtain an electromagnetic relay capable of attaching a counterpart member more reliably while simplifying an attachment process of the counterpart member.

Solution to Problem

In summary, a first aspect of the present invention provides an electromagnetic relay including: a contact device including a fixed terminal with a fixed contact formed, and a movable contactor with a movable contact formed to come into contact with and separate from the fixed contact; a housing storing the contact device therein; and a terminal portion including a screw portion exposed from the housing, the terminal portion being connected to the contact device, while a counterpart member is connected to the terminal portion. The terminal portion includes a first terminal portion where the screw portion is formed, and a second terminal portion connected to the first terminal portion. The first terminal portion and the second terminal portion are electrically connected to each other at least in a state where the counterpart member is connected to the terminal portion. A rotation restriction portion configured to restrict relative rotation between the first terminal portion and the second terminal portion is provided on at least one of the first terminal portion and the second terminal portion.

In summary, according to a second aspect of the present invention, the rotation restriction portion is at least partially made of a metal material.

In summary, according to a third aspect of the present invention, the first terminal portion includes a bolt having a polygonal head portion, and the rotation restriction portion has a wall portion provided on the second terminal portion and engaged with the head portion.

In summary, according to a fourth aspect of the present invention, when the first terminal portion and the second terminal portion are electrically connected to each other, a contact portion of the first terminal portion and a contact portion of the second terminal portion come into contact with each other, and a rotation restriction assisting member configured to assist restriction of relative rotation between the first terminal portion and the second terminal portion is provided between the contact portions of the first and second terminal portions.

Advantageous Effects of Invention

According to the present invention, the rotation restriction portion for restricting relative rotation between the first terminal portion and the second terminal portion is provided on at least one of the first terminal portion having the screw portion and the second terminal portion connected to the first terminal portion. Therefore, the counterpart member can be more surely attached, and an attachment process of the counterpart member can be simplified by eliminating the need to prepare additional members such as a bolt and a nut. Thus, according to the present invention, an electromagnetic relay can be obtained, which is capable of ensuring attachment of the counterpart member while simplifying the attachment process of the counterpart member.

DESCRIPTION OF EMBODIMENTS

With reference to the drawings, an embodiment of the present invention is described in detail below. Note that the following description is given on the assumption that top, bottom, right and left in FIG. 4(*b*) are, respectively, the top, bottom, right and left, and that the right-left direction in FIG. 4(*a*) is the front-back direction.

Figure 1:
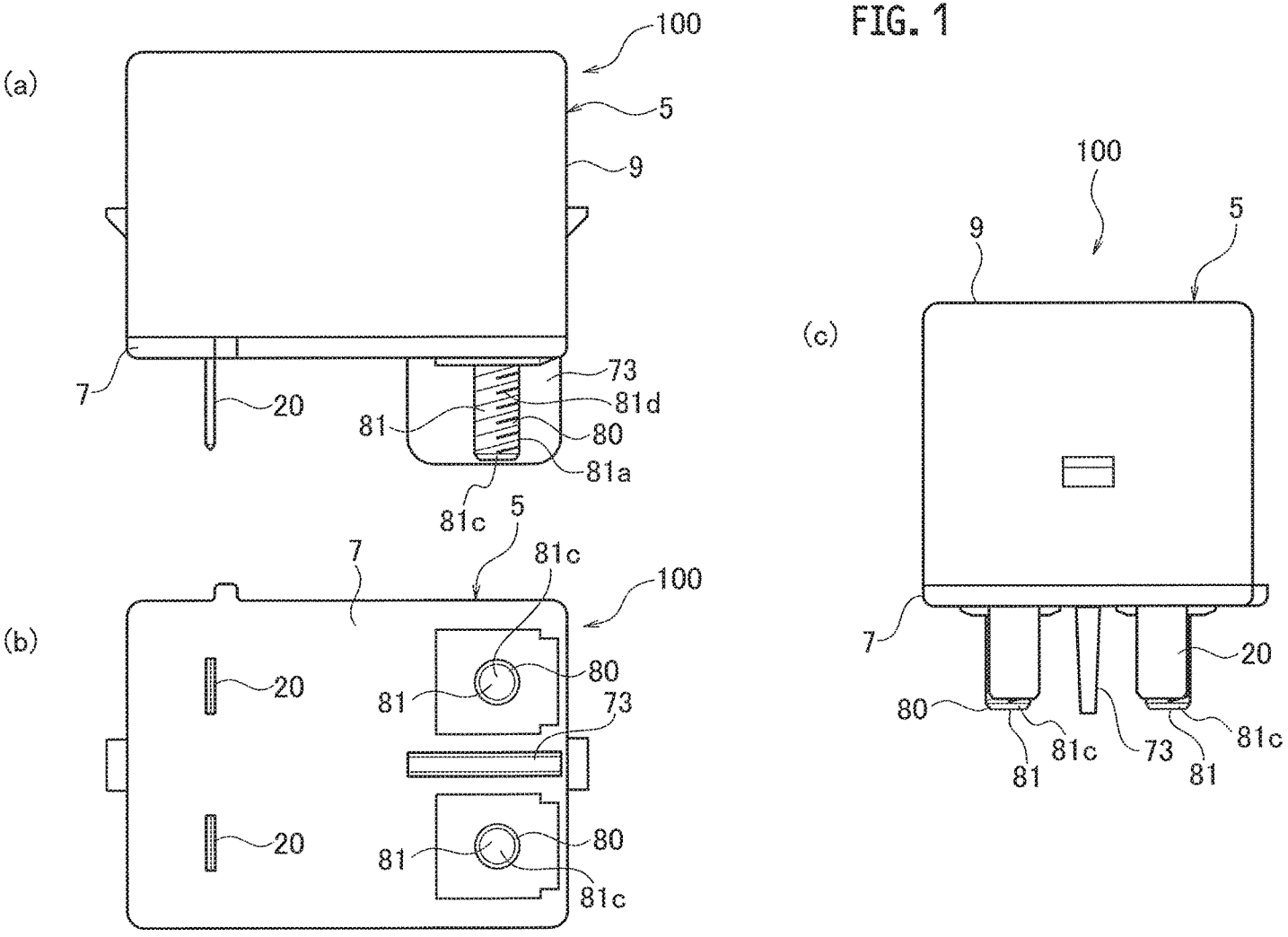
FIGS. 1(*a*) to 1(*c*) are views showing an electromagnetic relay according to an embodiment of the present invention, FIG. 1(*a*) being a side view, FIG. 1(*b*) being a back view and FIG. 1(*c*) being a front view.
Figure 2:
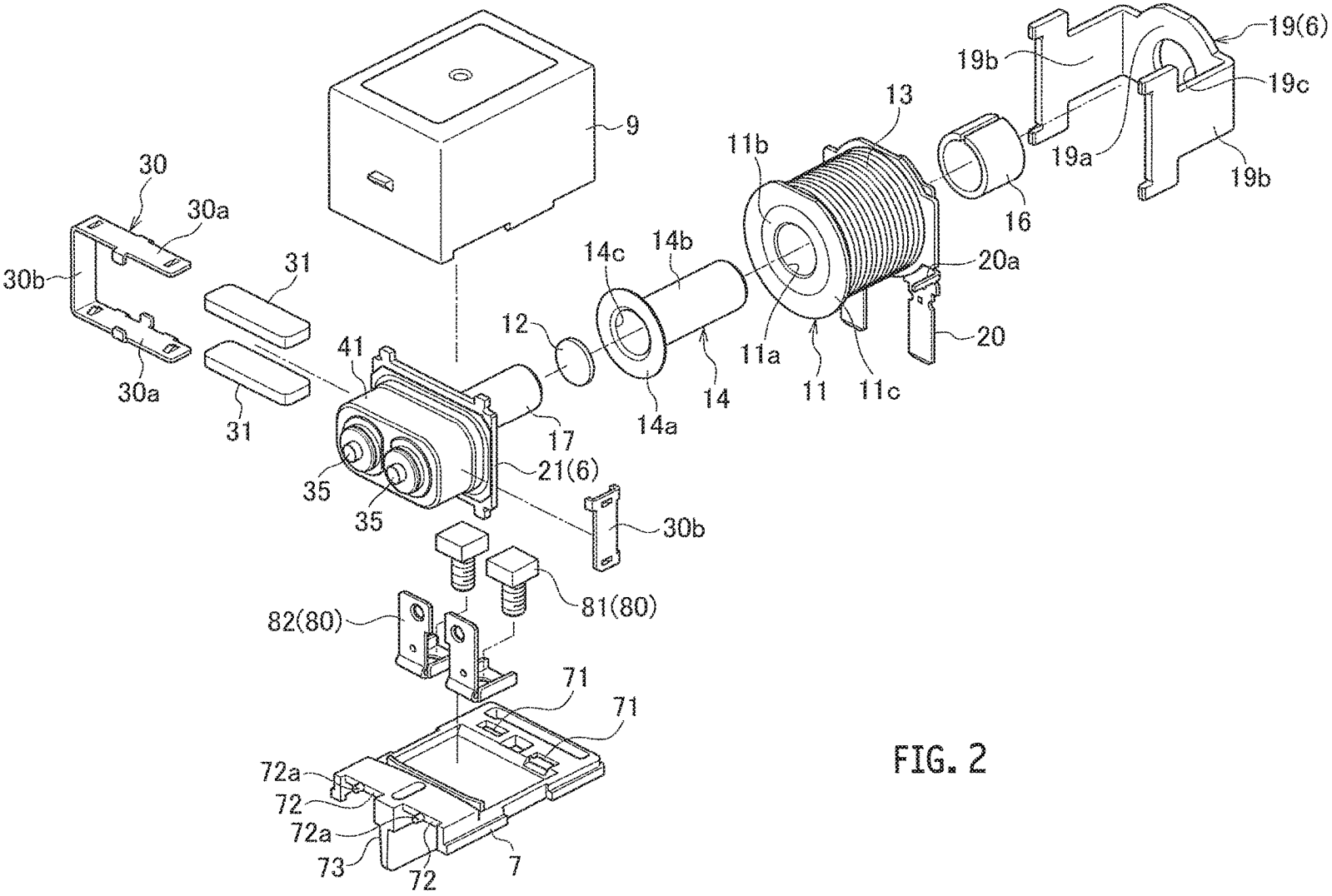
FIG. 2 is an exploded perspective view of the electromagnetic relay according to the embodiment of the present invention.
Figure 3:
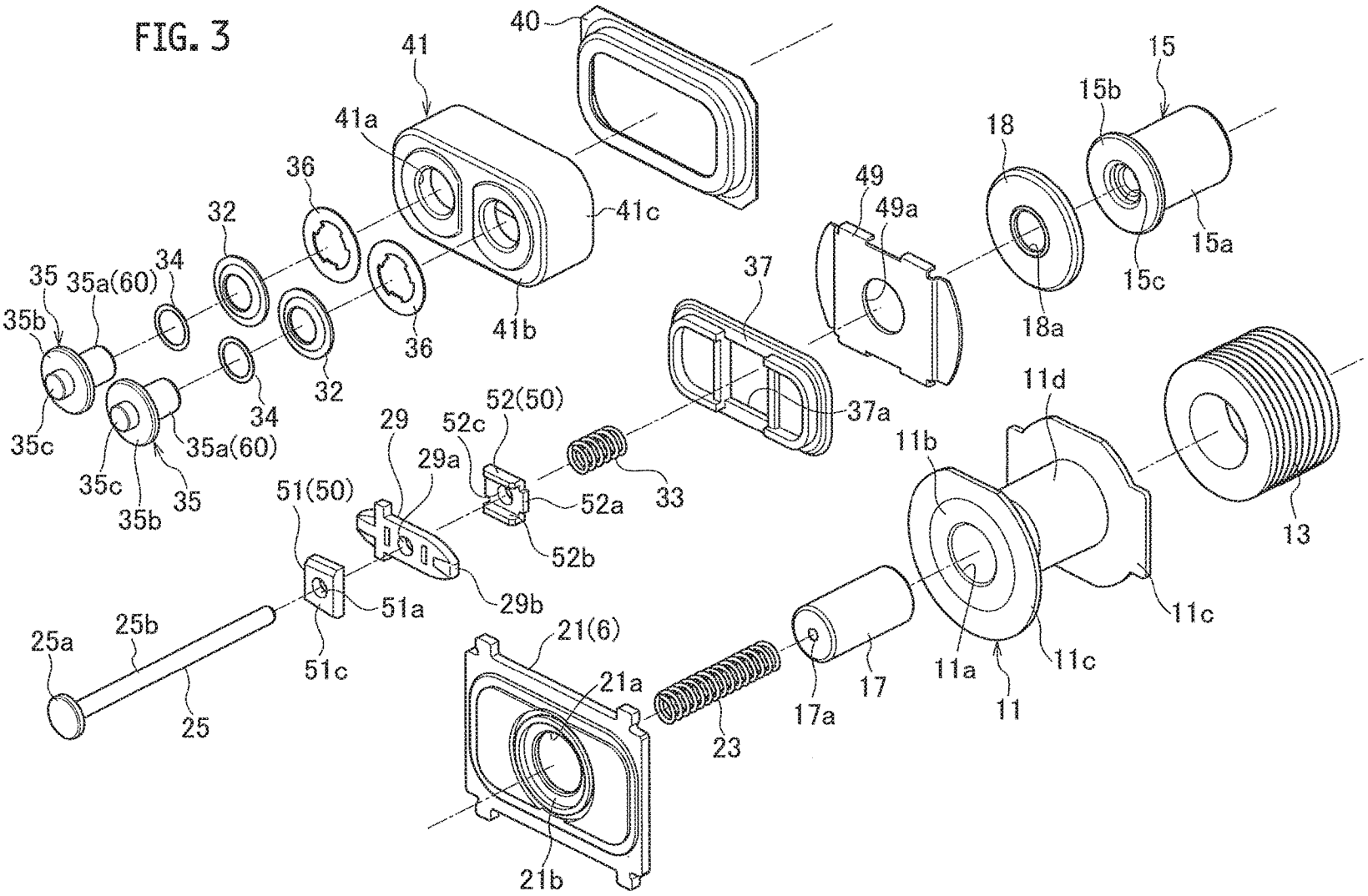
FIG. 3 is an exploded perspective view showing part of a contact device according to the embodiment of the present invention.

An electromagnetic relay 100 according to this embodiment is a so-called normally-open type having a contact off in an initial state. As shown in FIGS. 1 to 3, the electromagnetic relay 100 includes a contact device 1 constructed by integrally combining a drive block 2 positioned in a lower part with a contact block 3 positioned in an upper part. The contact device 1 is stored in a hollow box-shaped case (housing) 5. Note that it is also possible to use a so-called normally-closed electromagnetic relay having a contact on in an initial state.

The case 5 includes a substantially rectangular case base 7 and a case cover 9 storing mounted parts such as the drive block 2 and the contact block 3, which are disposed to cover the case base 7.

Figure 4:
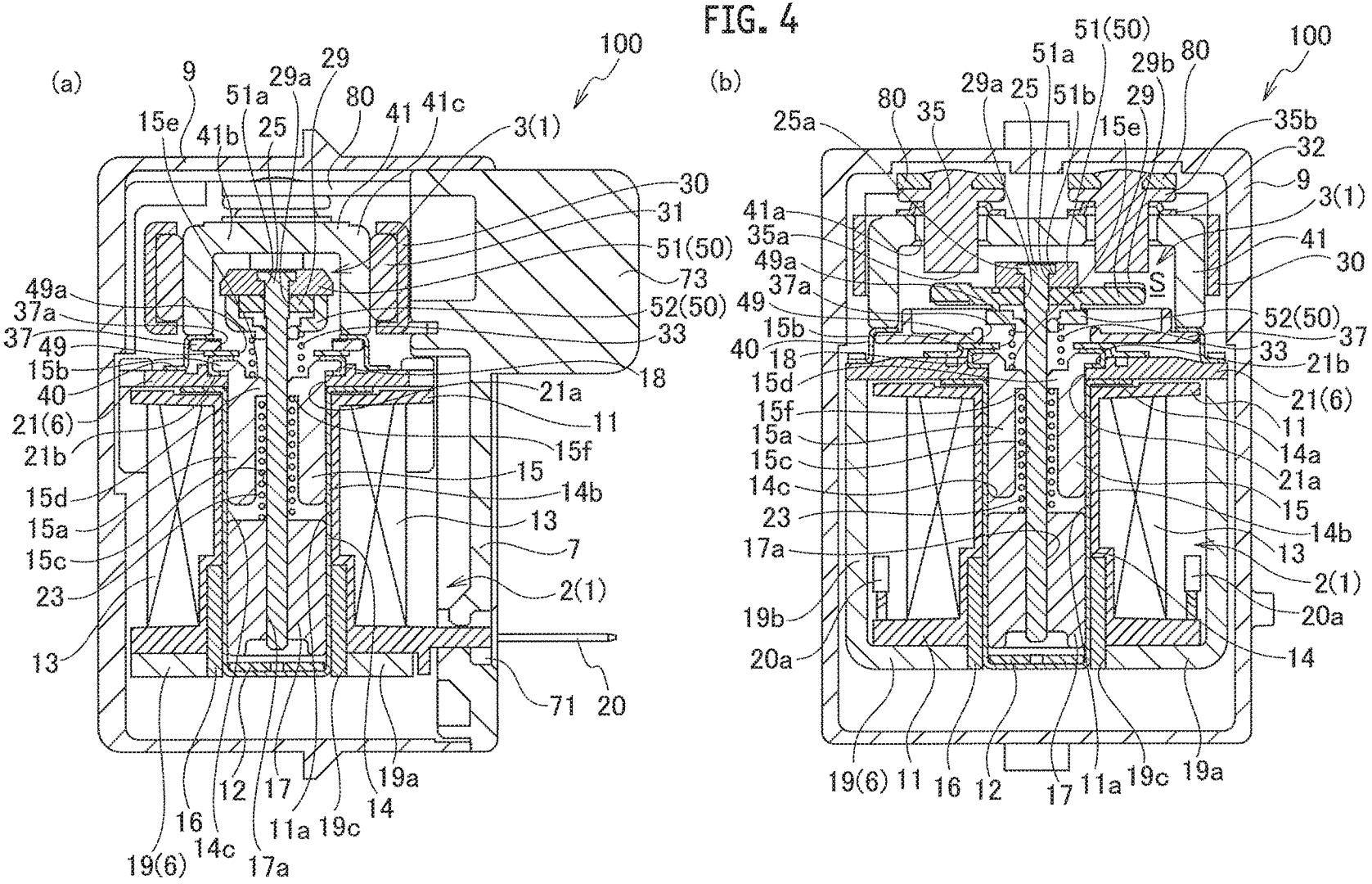
FIGS. 4(*a*) and 4(*b*) are views showing the electromagnetic relay according to the embodiment of the present invention, FIG. 4(*a*) being a sectional side view and FIG. 4(*b*) being a sectional side view taken along a direction perpendicular to a direction of view of FIG. 4(*a*).
Figure 5:
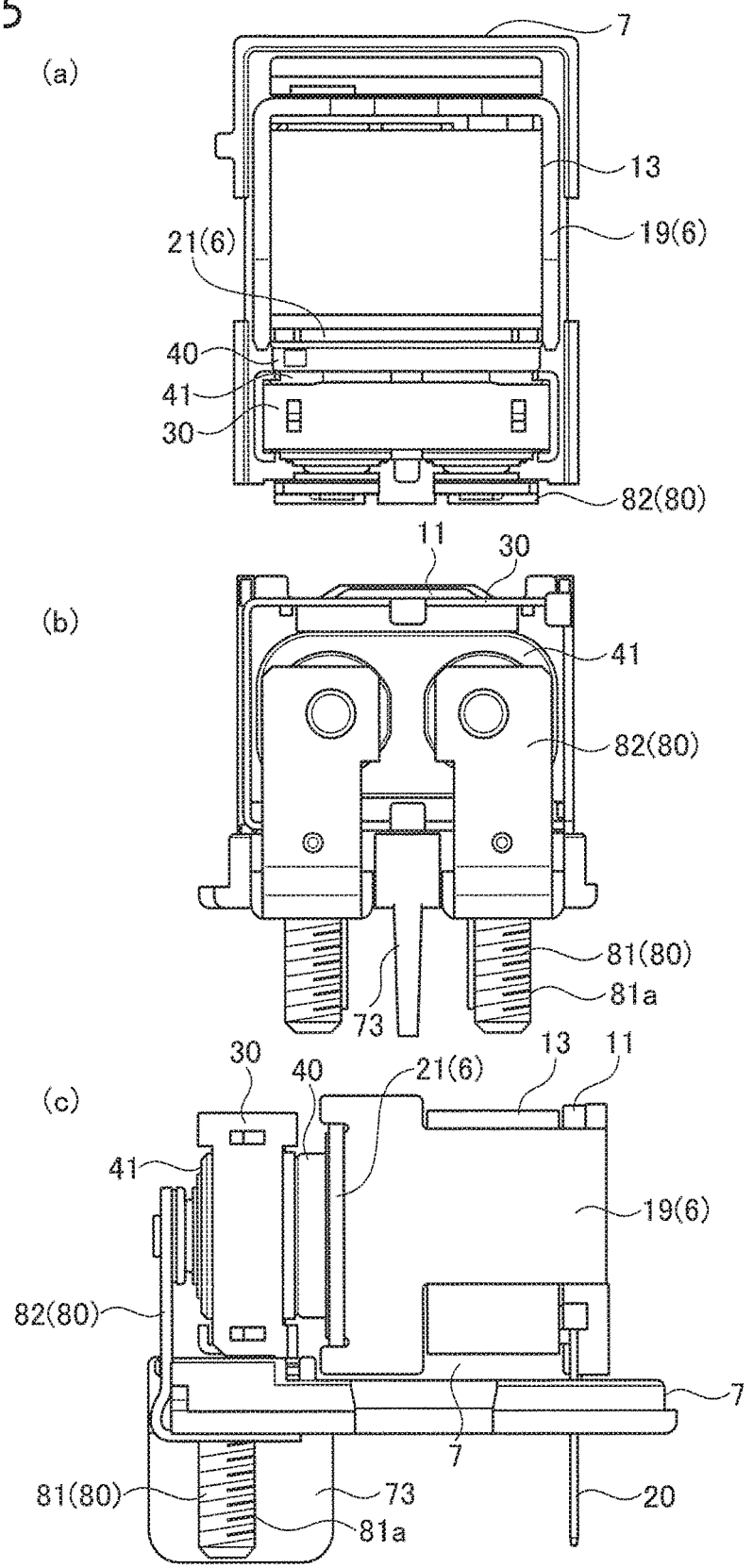
FIGS. 5(*a*) to 5(*c*) are views showing the electromagnetic relay according to the embodiment of the present invention in a state where a case cover is removed, FIG. 5(*a*) being a plan view, FIG. 5(*b*) being a back view and FIG. 5(*c*) being a side view.

The case base 7 is provided with a pair of slits 71 and 71 on the lower side in FIG. 4, into which a pair of coil terminals 20 are fitted. Also, on the upper side of the case base 7 in FIG. 4, a pair of notches 72 and 72 are provided, into which a pair of terminal portions 80 and 80 are fitted, respectively. Furthermore, on the rear side of the case base 7 (the right side of FIG. 4(*a*): side of the case base opposite to the case cover a wall 73 is provided, which protrudes backward and isolates the pair of terminal portions 80 and 80. The case cover 9 is formed into a hollow box shape having an opening on the case base 7 side.

The drive block 2 includes: a hollow cylindrical coil bobbin 11 having a coil 13 wound therearound; and the pair of coil terminals 20 which are fixed to the coil bobbin 11 and have both ends of the coil 13 connected thereto.

The coil bobbin 11 includes substantially circular flanges 11*c* protruding in a circumferential direction on both upper and lower ends of its cylindrical part. Between the upper and lower flanges 11*c*, a winding drum 11*d* is formed, around which the coil 13 is wound.

The coil terminal 20 is formed into a flat plate using a conductive material such as copper. The pair of coil terminals 20 have relay terminals 20*a* provided thereon. Also, lead wires on both ends of the coil 13 wound around the coil bobbin 11 are soldered in a bound state to the respective relay terminals 20*a*.

The drive block 2 is driven by energizing the coil 13 through the pair of coil terminals 20. The drive block 2 is thus driven to open and close a contact including a fixed contact 35*a* and a movable contact 29*b* of the contact block 3 to be described later. As a result, electrical connection and disconnection between a pair of fixed terminals 35 can be switched.

Moreover, the drive block 2 includes a yoke 6, which is made of a magnetic material and surrounds the coil bobbin 11. In this embodiment, the yoke 6 includes: a rectangular yoke upper wall 21 which comes in contact with an upper end surface of the coil bobbin 11; and a rectangular yoke 19 which comes in contact with a lower end surface and a lateral surface of the coil bobbin 11. The yoke 6 is opened in the front-back direction.

The yoke 19 is disposed between the coil 13 and the case 5, and includes a bottom wall 19*a* and a pair of side walls 19*b* and 19*b* standing up from the edges of the bottom wall 19*a*. In this embodiment, the bottom wall 19*a* and the pair of side walls 19*b* and 19*b* are continuously and integrally formed by bending a plate. The bottom wall 19*a* of the yoke 19 has an annular insertion hole 19*c* formed therein, and a bush 16 made of a magnetic material is inserted through the insertion hole 19*c*. The yoke upper wall 21 described above is disposed on the tip side (upper end side) of the pair of side walls 19*b* and 19*b* of the yoke 19 to cover the coil 13 wound around the coil bobbin 11.

The drive block 2 also includes: a fixed iron core 15 which is fixed to the inside of the cylindrical part of the coil bobbin 11 and magnetized by the energized coil 13; and a movable iron core 17 which faces the fixed iron core 15 in the vertical direction (axial direction) and is disposed inside the cylindrical part of the coil bobbin 11. The fixed iron core 15 is formed into a substantially columnar shape and has a flange 15*b* provided to protrude in the circumferential direction on the upper end of a protrusion 15*a*.

Furthermore, in this embodiment, the drive block 2 includes a plunger cap 14 between the coil bobbin 11, and the fixed iron core 15 and the movable iron core 17. The plunger cap 14 is made of a magnetic material and is formed into a closed-end cylindrical shape with an opening on its upper end. In this embodiment, the plunger cap 14 is disposed inside the insertion hole 11*a* formed in the center of the coil bobbin 11. Here, an annular seating surface 11*b* is formed on the upper side of the coil bobbin 11, and a flange 14*a* of the plunger cap 14 is placed on the seating surface 11*b*. Then, a protrusion 14*b* of the plunger cap 14 is fitted into the insertion hole 11*a*. The fixed iron core 15 and the movable iron core 17 are stored in the plunger cap 14 provided in the cylindrical part of the coil bobbin 11. Note that the fixed iron core 15 is disposed on the opening side of the plunger cap 14.

Furthermore, the fixed iron core 15 and the movable iron core 17 are formed into a columnar shape whose outside diameter is substantially the same as the inside diameter of the plunger cap 14. The movable iron core 17 is configured to slide inside the cylindrical part of the plunger cap 14. This movement range of the movable iron core 17 is set between an initial position away from the fixed iron core 15 and a contact position that comes in contact with the fixed iron core 15. Moreover, a return spring 23 is interposed between the fixed iron core 15 and the movable iron core 17. The return spring 23 is made of a coil spring and urges the movable iron core 17 in a direction of returning to the initial position. The movable iron core 17 is urged in a direction away from the fixed iron core 15 (upward in FIG. 4) by the return spring 23. Note that, in this embodiment, a protrusion 15*d* protruding toward the center to reduce the hole diameter is provided over the whole circumference inside the insertion hole 15*c* of the fixed iron core 15. A lower surface 15*f* of the protrusion 15*d* serves as a spring receiver for the return spring 23.

Moreover, an insertion hole 21*a* is provided in the center of the yoke upper wall 21, through which the fixed iron core 15 is inserted. When inserting the fixed iron core 15, the protrusion 15*a* of the fixed iron core 15 is inserted from the upper side of the yoke upper wall 21. Here, a recess 21*b* having substantially the same diameter as that of the flange 15*b* of the fixed iron core 15 is provided substantially in the center of the upper surface of the yoke upper wall 21. The flange 15*b* of the fixed iron core 15 is fitted into the recess 21*b*, thereby preventing the fixed iron core 15 from coming off the yoke upper wall 21.

Furthermore, a metal retainer plate 49 is provided on the upper surface side of the yoke upper wall 21, and right and left ends thereof are fixed to the upper surface of the yoke upper wall 21. A center convex of the retainer plate 49 is provided to form a space for storing the flange 15*b* of the fixed iron core 15 protruding from the upper surface of the yoke upper wall 21. Furthermore, in this embodiment, an iron core rubber 18 made of a material (e.g., synthetic rubber) having rubber elasticity is provided between the fixed iron core 15 and the retainer plate 49, so that vibration from the fixed iron core 15 is not directly transmitted to the retainer plate 49. The iron core rubber 18 is formed into a disc shape and has an insertion hole 18*a* provided in its center, through which a shaft (drive shaft) 25 to be described later is inserted. Furthermore, in this embodiment, the iron core rubber 18 is fitted to the fixed iron core 15 to wrap the flange 15*b*.

A flange 14*a* protruding in the circumferential direction is formed on the opening side of the plunger cap 14, and the flange 14*a* is fixed to the periphery of the insertion hole 21*a* in the lower surface of the yoke upper wall 21. Also, a lower end bottom of the plunger cap 14 is inserted through the bush 16 fitted into the insertion hole 19*c* in the bottom wall 19*a*. Here, the movable iron core 17 stored in the lower part of the plunger cap 14 is magnetically connected to the peripheral portion of the bush 16.

With such a configuration, during energization of the coil 13, the surface of the fixed iron core 15 facing the movable iron core 17 and the peripheral portion of the bottom wall 19*a* around the bush 16 have afferent polarities as a pair of magnetic poles, and the movable iron core 17 is attracted by the fixed iron core 15 to move to the contact position. On the other hand, when the energization of the coil 13 is stopped, the movable iron core 17 is returned to the initial position by the return spring 23. Note that the return spring 23 is inserted through the insertion hole 15*c* of the fixed iron core 15, and has the upper end coming in contact with the lower surface 15*f* of the protrusion 15*d* and the lower surface coming in contact with the upper surface of the movable iron core 17. Furthermore, in this embodiment, a damper rubber 12 made of a material having rubber elasticity and formed to have substantially the same diameter as the outside diameter of the movable iron core 17 is provided at the bottom inside the plunger cap 14.

Moreover, the contact block 3 configured to open and close the contact according to on and off of the energization of the coil 13 is provided above the drive block 2.

The contact block 3 includes a base 41 made of a heat-resistant material and formed into a box shape having an opening in its lower surface. Also, two insertion holes 41*a* are provided in the ceiling of the base 41, and a pair of fixed terminals 35 are inserted through the insertion holes 41*a* while sandwiching lower flanges 32. The fixed terminals 35 are made of a conductive material such as a copper-base material and formed into a cylindrical shape. The fixed contact 35*a* is formed on the lower end surface of each of the fixed terminals 35, and a flange 35*b* protruding in the circumferential direction is formed on the upper end thereof. Also, a protrusion 35*c* is provided in the center of the flange 35*b*. The upper surface of the lower flange 32 and the flange 35*b* of the fixed terminal 35 are hermetically connected with a silver solder 34, while the lower surface of the lower flange 32 and the upper surface of the base 41 are also hermetically connected with a silver solder 36.

Moreover, a pair of terminal portions 80 and 80 connected to a counterpart member (such as a bus bar, a harness and a round terminal) 90 such as an external load are attached to the fixed terminals 35. The terminal portions 80 and 80 are formed using a conductive metal material and have insertion holes 82*a* and 82*a* in their front ends, through which the protrusions 35*c* of the fixed terminals 35 are inserted. The terminal portions 80 and 80 are fixed to the fixed terminals 35 by spin-caulking the protrusions 35*c* inserted through the insertion holes 82*a* and 82*a*.

Inside the base 41, a movable contactor 29 is disposed across the pair of fixed contacts 35*a*, and movable contacts 29*b* are provided at positions facing the fixed contacts 35*a* on the upper surface of the movable contactor 29. Also, the movable contactor 29 has an insertion hole 29*a* provided in its center, through which one end of a shaft 25 connecting the movable contactor 29 to the movable iron core 17 is inserted.

The shaft 25 is made of a non-magnetic material and includes: a shaft main body 25*b* in the shape of a round bar that is elongated in the movement direction (vertical direction) of the movable iron core 17; and a flange 25*a* formed to protrude in the circumferential direction in the portion protruding upward from the movable contactor 29.

Furthermore, an insulating plate 37 and a contact-pressure spring (urging member) 33 are provided between the movable contactor 29 and the retainer plate 49. The insulating plate 37 is made of an insulating material to cover the retainer plate 49. The contact-pressure spring 33 is made of a coil spring, through which the shaft 25 is inserted. Note that the insulating plate 37 has an insertion hole 37*a* provided in its center, through which the shaft 25 is inserted. The movable contactor 29 is urged upward (toward one side in the drive shaft direction) by the contact-pressure spring 33.

Here, the positional relationship between the movable iron core 17 and the movable contactor 29 is set such that the movable contact 29*b* and the fixed contact 35*a* are separated from each other when the movable iron core 17 is at the initial position, and the movable contact 29*b* and the fixed contact 35*a* come in contact with each other when the movable iron core 17 is at the contact position. More specifically, the fixed terminals 35 are insulated from each other by turning off the contact device 3 in a period during which the coil 13 is not energized, while the fixed terminals 35 are electrically connected to each other by turning on the contact device 3 in a period during which the coil 13 is energized. Note that the contact pressure between the movable contact 29*b* and the fixed contact 35*a* is obtained by the contact-pressure spring 33.

Meanwhile, when a current flows in a state where the movable contacts 29*b* of the movable contactor 29 are in contact with the fixed contacts 35*a* and 35*a*, the current generates electromagnetic repulsion force between the movable contactor 29 and the fixed contacts 35*a* and 35*a*. When the electromagnetic repulsion force acts between the movable contactor 29 and the fixed contacts 35*a* and 35*a*, joule heat is drastically increased due to reduced contact pressure and increased contact resistance, or arc heat is generated by opening of the contact. As a result, the movable contacts 29*b* and the fixed contacts 35*a* may be welded together.

Therefore, in this embodiment, a yoke 50 is provided, which is disposed (disposed in contact with the lower surface 29*d*) at least below the movable contactor 29 (on the other side in the drive shaft direction), in a state where the movable contacts 29*b* are in contact with the fixed contacts 35*a* (in a power-on state in this embodiment).

To be more specific, the yoke 50 surrounding the upper and lower surfaces 29*c* and 29*d* and side surface 29*e* of the movable contactor 29 includes an upper yoke (second yoke) 51 disposed above the movable contactor 29 and a lower yoke (first yoke) 52 surrounding the lower side and lateral part of the movable contactor 29. Specifically, the yoke 50 is disposed (disposed in contact with the lower surface 29*d*) at least below the movable contactor 29 (on the other side in the drive shaft direction), also in a state where the movable contacts 29*b* are separated from the fixed contacts 35*a* (in a power-off state in this embodiment).

The movable contactor 29 is surrounded by the upper yoke 51 and the lower yoke 52 as described above, thus forming a magnetic circuit between the upper yoke 51 and the lower yoke 52.

When a current flows during contact between the movable contacts 29*b* and the fixed contacts 35*a* and 35*a*, the upper yoke 51 and lower yoke 52 thus provided generate magnetic forces attracting each other based on the current. The magnetic forces attracting each other thus generated cause the upper yoke 51 and the lower yoke 52 to attract each other. This attraction between the upper yoke 51 and the lower yoke 52 presses the movable contactor 29 against the fixed contacts 35*a*, thereby restricting the action of the movable contactor 29 trying to separate from the fixed contacts 35*a*. By restricting the action of the movable contactor 29 trying to separate from the fixed contacts 35*a* as described above, the movable contacts 29*b* attach to the fixed contacts 35*a* without the movable contactor 29 repelling the fixed contacts 35*a*, thereby suppressing generation of arc. As a result, contact welding due to generation of the arc can be suppressed.

Moreover, in this embodiment, the upper yoke 51 is formed into a substantially rectangular plate shape, and the lower yoke 52 is formed into a substantially U-shape, including a bottom wall 52*a* and side walls 52*b* formed to stand up from both ends of the bottom wall 52*a*. Here, it is preferable that upper end faces of the side walls 52*b* of the lower yoke 52 come in contact with the lower surface of the upper yoke 51, as shown in FIG. 4(*a*). However, the upper end faces of the side walls 52*b* of the lower yoke 52 may also be configured not to come in contact with the lower surface of the upper yoke 51.

In this embodiment, the movable contactor 29 is urged upward by the contact-pressure spring 33. To be more specific, the contact-pressure spring 33 is configured to have the upper end coming in contact with the lower surface of the bottom wall 52*a* of the lower yoke 52 and to have the lower end coming in contact with an upper surface 15*e* of the protrusion 15*d*. Thus, in this embodiment, the upper surface 15*e* of the protrusion 15*d* serves as a spring receiver for the contact-pressure spring 33.

Moreover, the upper yoke 51, the lower yoke 52 and the retainer plate 49 have an insertion hole 51*a*, an insertion hole 52*c* and an insertion hole 49*a* formed therein, respectively, through which the shaft 25 is to be inserted.

The movable contactor 29 is attached to one end of the shaft 25 as described below.

First, the movable iron core 17, the return spring 23, the yoke upper wall 21, the fixed iron core 15, the iron core rubber 18, the retainer plate 49, the insulating plate 37, the contact-pressure spring 33, the lower yoke 52, the movable contactor 29 and the upper yoke 51 are disposed in this order from the bottom. Here, the return spring 23 is inserted through the insertion hole 15*c* of the fixed iron core 15 having the protrusion 15*a* fitted through the insertion hole 21*a* of the yoke upper wall 21 and the insertion hole 14*c* of the plunger cap 14.

Then, the main body 25*b* of the shaft 25 is inserted through the insertion holes 51*a*, 29*a*, 52*c*, 37*a*, 49*a*, 18*a*, 15*c*, 21*a*, the contact-pressure spring 33 and the return spring 23 from above the upper yoke 51, and then inserted through the insertion hole 17*a* of the movable iron core 17, thereby connecting the shaft 25 to the movable iron core 17. Note that the connection of the shaft 25 to the movable iron core 17 is performed by using a rivet while crushing the tip or by forming a thread groove on the other end of the shaft 25 and screwing the shaft onto the movable iron core 17.

Thus, the movable contactor 29 is attached to one end of the shaft 25. In this embodiment, an annular seating surface 51*b* is formed on the upper side of the upper yoke 51, and the flange 25*a* of the shaft 25 is stored on the seating surface 51*b*, thereby preventing the shaft 25 from coming off while suppressing the shaft 25 from protruding upward. Note that the shaft 25 may also be fixed to the upper yoke 51 by laser welding and the like.

Moreover, the insertion hole 15*c* provided in the fixed iron core 15 is set to have an inside diameter larger than the outside diameter of the shaft 25 so that at least the shaft 25 does not come in contact with the fixed iron core 15. With such a configuration, the movable contactor 29 is moved in the vertical direction together with the movement of the movable iron core 17.

Moreover, in this embodiment, gas is injected into the base 41 in order to suppress arc generated between the movable contacts 29*b* and the fixed contacts 35*a* when the movable contacts 29*b* are separated from the fixed contacts 35*a*. As such gas, mixture gas can be used, mainly including hydrogen gas most excellent in thermal conduction in a temperature region in which the arc is generated. In this embodiment, an upper flange 40 covering a gap between the base 41 and the yoke upper wall 21 is provided to seal the gas.

To be more specific, the base 41 is formed into a hollow box shape having an opening on the lower side (movable contactor 29 side), including: a ceiling 41*b* having a pair of insertion holes 41*a* provided in parallel; and a rectangular cylindrical wall 41*c* provided to protrude downward from the edge of the ceiling 41*b*. The base 41 is fixed to the yoke upper wall 21 through the upper flange 40 in a state where the movable contactor 29 is stored inside the wall 41*c* from the opened lower side.

In this embodiment, the opening edge of the lower surface of the base 41 and the upper surface of the upper flange 40 are hermetically connected with silver solder (not shown), and the lower surface of the upper flange 40 and the upper surface of the yoke upper wall 21 are hermetically connected by arc welding or the like. Furthermore, the lower surface of the yoke upper wall 21 and the flange 14*a* of the plunger cap 14 are hermetically connected by arc welding or the like. Thus, a sealed space S with the gas sealed therein is formed inside the base 41.

Furthermore, in parallel with the arc suppression method using the gas, the arc is suppressed using a capsule yoke in this embodiment. The capsule yoke includes a magnetic member 30 and a pair of permanent magnets 31. The magnetic member 30 is made of a magnetic material, such as iron, and formed into a substantially frame shape. The magnetic member 30 includes a pair of side pieces 30*a* facing each other, and a pair of side pieces 30*b* facing each other. In this embodiment, one of the side pieces 30*b* is formed integrally with the both-side pieces 30*a* to connect base ends of the both-side pieces 30*a*. Also, both ends of the other side piece 30*b* are connected to the tips of the respective both-side pieces 30*a*, to form the magnetic member 30 having a substantially rectangular frame shape in a plan view.

The permanent magnets 31 are attached to the both-side pieces 30*a* of the magnetic member 30 to face the respective both side pieces 30*a*. The permanent magnets 31 provide the base 41 with a magnetic field substantially orthogonal to a direction of the movable contacts 29*a* coining in contact with and separating from the fixed contacts 35*a*. Thus, the arc is extended in the direction orthogonal to the movement direction of the movable contactor 29, and is cooled by the gas sealed in the base 41. Accordingly, the arc voltage is drastically increased, and the arc is interrupted when the arc voltage exceeds the voltage between the contacts. More specifically, the electromagnetic relay 100 of this embodiment takes measures against the arc with magnetic blow by the capsule yoke and cooling by the gas sealed in the base 41. Accordingly, the arc can be interrupted in a short time, and consumption of the fixed contacts 35*a* and the movable contacts 29*b* can be reduced.

Meanwhile, in the electromagnetic relay 100 of this embodiment, since the movable iron core 17 is guided in the movement direction (vertical direction) by the plunger cap 14, the position within the plane orthogonal to the movement direction is restricted. Therefore, the position of the movable iron core 17 within the plane orthogonal to the movement direction is also restricted in the shaft 25 connected to the movable iron core 17. Furthermore, in this embodiment, the position of the shaft 25 within the plane orthogonal to the movement direction of the movable iron core 17 is restricted by inserting the shaft 25 through the insertion hole 15*c* also in the fixed iron core 15. That is, the insertion hole 15*c* of the fixed iron core 15 is formed such that the inside diameter of the portion where the protrusion 15*d* is formed is substantially the same as the outside diameter of the shaft 25. In other words, the insertion hole 15*c* is set to have a diameter that allows the shaft 25 to move in the vertical direction while restricting the movement of the shaft 25 from front to back and from side to side.

With such a configuration, the tilt of the shaft 25 relative to the movement direction of the movable iron core 17 is restricted at two spots, i.e., the plunger cap 14 and the protrusion 15*d* of the fixed iron core 15. Therefore, even if the shaft 25 is about to tilt relative to the movement direction of the movable iron core 17, the position of the shaft 25 within the plane orthogonal to the movement direction of the movable iron core 17 is restricted at two spots, i.e., the lower end of the movable iron core 17 and the protrusion 15*d* of the fixed iron core 15. Thus, the tilt of the shaft 25 is restricted. As a result, the shaft 25 is moved in a straight line, and the shaft 25 can be prevented from tilting.

Next, operations of the contact device 1 are described.

First, in a state where the coil 13 is not energized, elastic force of the return spring 23 overcomes elastic force of the contact-pressure spring 33. Thus, the movable iron core 17 moves in a direction away from the fixed iron core 15, leaving the movable contact 29*b* in a state of being separated from the fixed contact 35*a* as shown in FIGS. 4(*a*) and 4(*b*).

When the coil 13 is energized from the off state described above, the movable iron core 17 is moved closer to the fixed iron core 15 such that the movable iron core 17 is attracted to the fixed iron core 15 against the elastic force of the return spring 23 by the electromagnetic force. Along with this upward movement (toward the fixed iron core 15) of the movable iron core 17, the shaft 25, the upper yoke 51 attached to the shaft 25, the movable contactor 29 and the lower yoke 52 are moved upward (toward the fixed contact 35*a*). Thus, the movable contact 29*b* of the movable contactor 29 comes into contact with the fixed contact 35*a* of the fixed terminal 35, and thus the contacts are electrically connected to each other to turn on the contact device 1.

Here, in this embodiment, the counterpart member (bus bar, harness, round terminal or the like) 90 can be more easily fastened (connected) to the terminal portion 80 connected to the contact device 1 (fixed contact 35).

To be more specific, as shown in FIG. 1, the terminal portions 80 and 80 connected to the contact device 1 (fixed contact 35) are configured to have screw portions 81*a* and 81*a*, which are exposed from the case (housing) 5. By providing the screw portions 81*a* exposed from the case (housing) 5 in the terminal portions 80 as described above, the counterpart member (bus bar, harness, round terminal or the like) 90 can be fastened (connected) to the terminal portions 80 just by screwing nuts 91 to the screw portions 81*a*.

Furthermore, in this embodiment, each of the terminal portions 80 and 80 includes plural members.

To be more specific, as shown in FIGS. 5 to 8, the terminal portion 80 includes: an outside terminal portion (first terminal portion) 81 having the screw portion 81*a* formed thereon; and an inside terminal portion (second terminal portion) 82 connected to the outside terminal portion 81.

The outside terminal portion 81 includes a bolt having a square (polygonal) head portion 81*b*. More specifically, the outside terminal portion 81 includes the square (polygonal) head portion 81*b* and a shaft 81*c* connected to the head portion 81*b*. The screw portion 81*a* exposed from the case (housing) 5 is formed by providing a thread groove 81*d* in the shaft 81*c*.

The inside terminal portion 82 includes a flat connecting plate (connector) 82*b* having an insertion hole 82*a* formed therein, through which the protrusion 35*c* of the fixed terminal 35 is inserted. The inside terminal portion 82 further includes a supporting plate (support) 82*c* which extends in a direction intersecting (orthogonal to) the extending direction of the connecting plate 82*b* and supports the outside terminal portion 81. The supporting plate 82*c* has an insertion hole 82*d* formed therein, through which the shaft 81*c* of the outside terminal portion 81 is inserted. The inside terminal portion 82 also includes a connector 82*e* connecting the supporting plate 82*c* to the connecting plate 82*b*. The connector 82*e* is curved to be convex outward. Then, elastic deformation of the connector 82*e* enables movement of the supporting plate 82*c* relative to the connecting plate 82*b* to change the angle formed by the supporting plate 82*c* and the connecting plate 82*b*. More specifically, the supporting plate 82*c* can be turned about the connector 82*e* relative to the connecting plate 82*b*. Moreover, the elastic deformation of the connector 82*e* can prevent the force applied to the supporting plate 82*c* from being transmitted to the connecting plate 82*b*.

As described above, the inside terminal 82 portion includes the connecting plate 82*b*, the connector 82*e* and the supporting plate 82*c*, and is formed into a substantially L-shape in the side view. In this embodiment, the connecting plate 82*b*, the connector 82*e* and the supporting plate 82*c* are continuously and integrally formed by bending a plate.

Figure 6:
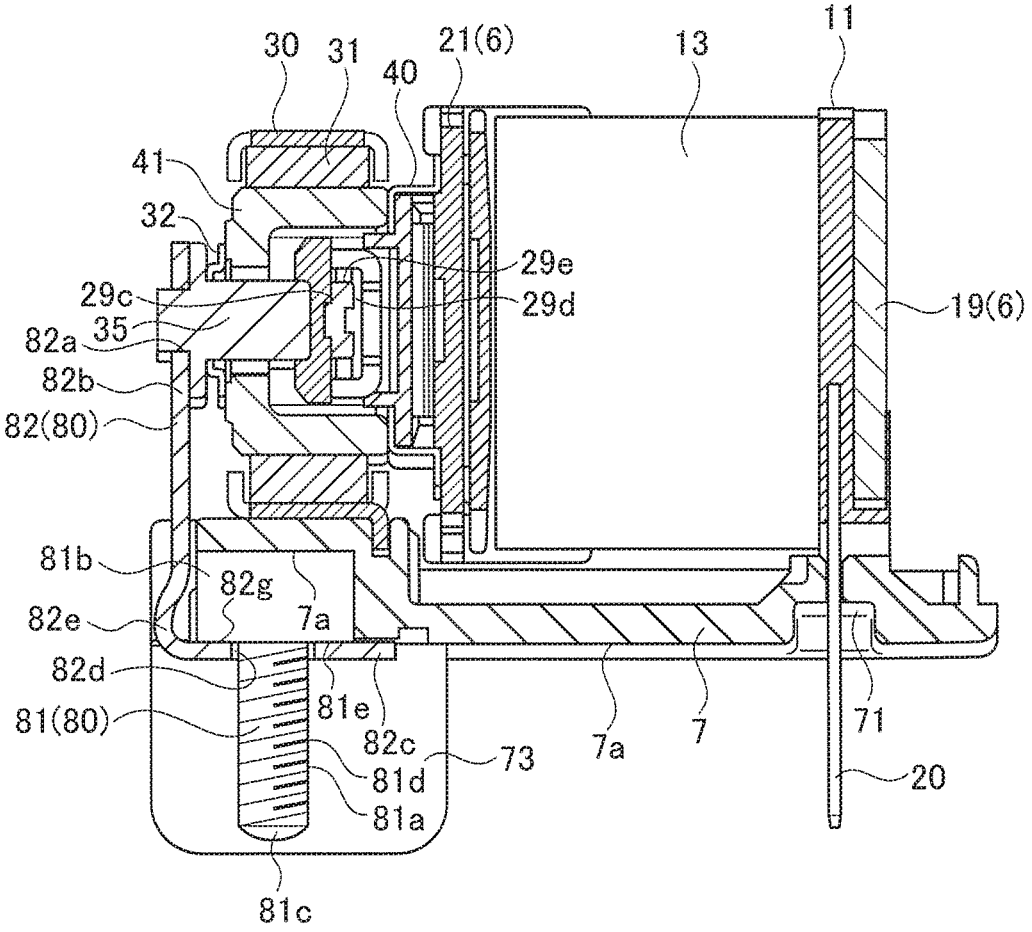
FIG. 6 is a sectional side view showing the electromagnetic relay according to the embodiment of the present invention in the state where the case cover is removed.

Moreover, the connecting plate 82*b* has an insertion hole 82*f* formed therein, through which a protrusion 72*a* formed in the notch 72 of the case base 7 is inserted. The connecting plate 82*b* (the inside terminal portion 82) is fixed to the case base 7 by inserting the protrusion 72*a* through the insertion hole 82*f* in a state where the shaft 81*c* of the outside terminal portion 81 is inserted through the insertion hole 82*d* (see. FIG. 6). Here, the head portion 81*b* is disposed between a rear surface (outer surface) 7*a* of the case base 7 and a surface 82*g* (contact surface with the head portion 81*b*) of the supporting plate 82*c* facing the case base. Then, the screw portion 81*a* is exposed from the case (housing) 5 in a state where the tip faces outward.

Moreover, in this embodiment, the outside terminal portion 81 and the inside terminal portion 82 are not fixed by welding, caulking or the like, but are connected to each other when the counterpart member (bus bar, harness, round terminal or the like) 90 is fastened (connected) to the terminal portion 80.

More specifically, in a state where the counterpart member 90 is not fastened (connected) to the terminal portion 80, the outside terminal portion 81 is supported by the inside terminal portion 82 in a state of being capable of relative movement (relative rotation or the like) to the inside terminal portion 82. Note that the relative movement (relative rotation or the like) of the outside terminal portion 81 to the inside terminal portion 82 may be restricted by forming a temporary joint or the like between the outside terminal portion 81 and the inside terminal portion 82 in the state where the counterpart member 90 is not fastened (connected) to the terminal portion 80. Here, the outside terminal portion 81 and the inside terminal portion 82 may be or may not be electrically connected to each other.

As described above, it suffices that the outside terminal portion 81 and the inside terminal portion 82 are electrically connected to each other at least in a state where the counterpart member 90 is connected to the terminal portion 80. In other words, the outside terminal portion 81 and the inside terminal portion 82 may be or may not be electrically connected to each other in the state where the counterpart member 90 is not fastened (connected) to the terminal portion 80.

Figure 9:
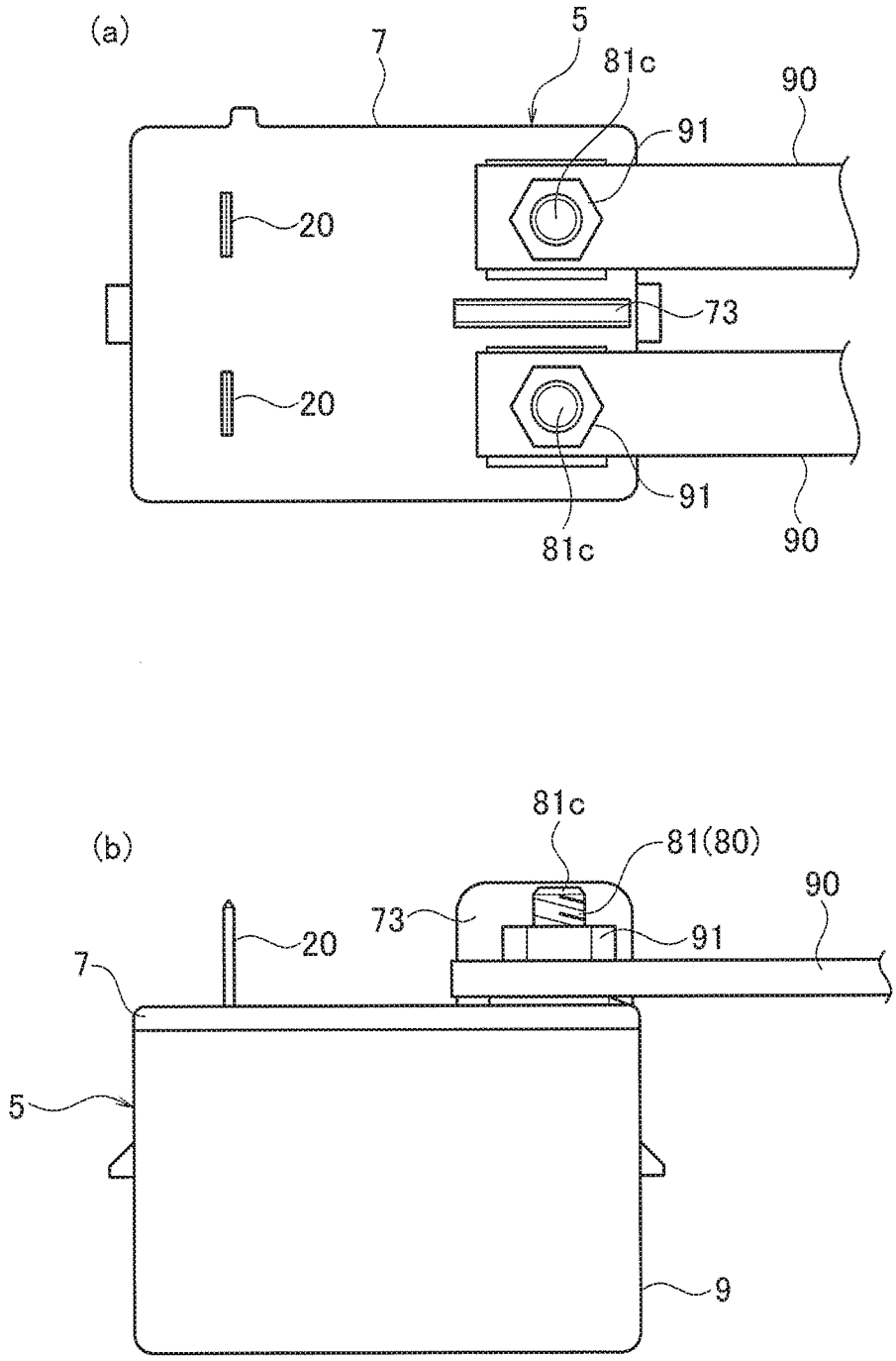
FIGS. 9(*a*) and 9(*b*) are views showing a state where a counterpart member is attached to the terminal portion according to the embodiment of the present invention, FIG. 9(*a*) being a back view and FIG. 9(*b*) being a side view.
Figure 10:
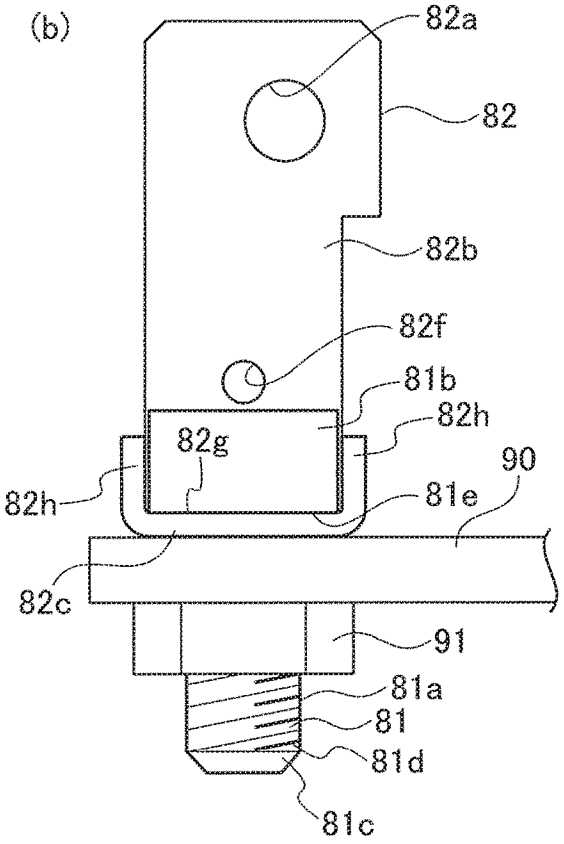
FIGS. 10(*a*) and 10(*b*) are views schematically showing a method for fixing the terminal portion and the counterpart member according to the embodiment of the present invention, FIG. 10(*a*) being a front view showing a state before both are fixed and FIG. 10(*b*) being a front view showing a state after both are fixed.
Figure 10:
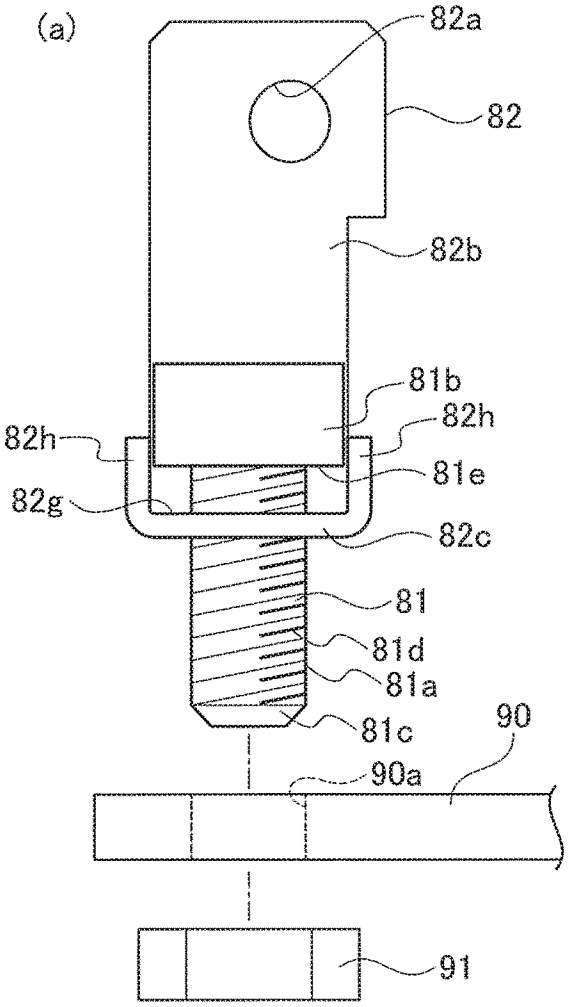

Then, the counterpart member 90 is fastened (connected) to the terminal portion 80, and the outside terminal portion 81 and the inside terminal portion 82 are connected to each other by screwing the nut 91 onto the screw portion 81*a* in a state where the shaft 81*c* having the screw portion 81*a* formed thereon is inserted through the insertion hole 90*a* formed in the counterpart member 90 (see FIGS. 9 and 10). As described above, in this embodiment, the outside terminal portion 81 and the inside terminal portion 82 are connected to each other while fastening the counterpart member 90 to the terminal portion 80 by using axial force generated when the counterpart member 90 is fastened to the terminal portion 80.

Meanwhile, when the outside terminal portion 81 is supported on the inside terminal portion 82 in the state of being capable of relative movement (relative rotation or the like) to the inside terminal portion 82, the outside terminal portion 81 may be rotated (co-rotated) with the nut 91 when the nut 91 is screwed onto the screw portion 81*a*. Note that, even when a temporary joint or the like is formed between the outside terminal portion 81 and the inside terminal portion 82, the outside terminal portion 81 may be rotated (co-rotated) with the nut 91 when the nut 91 is screwed onto the screw portion 81*a*. Therefore, the screwing operation needs to be performed while fixing the outside terminal portion 81 so that the outside terminal portion 81 is not co-rotated with the nut 91 when the nut 91 is screwed onto the screw portion 81*a*.

A jig has heretofore been used as an additional member to perform such an operation. However, the use of such a jig as the additional member complicates the operation of fastening the counterpart member 90 to the terminal portion 80.

Figure 7:
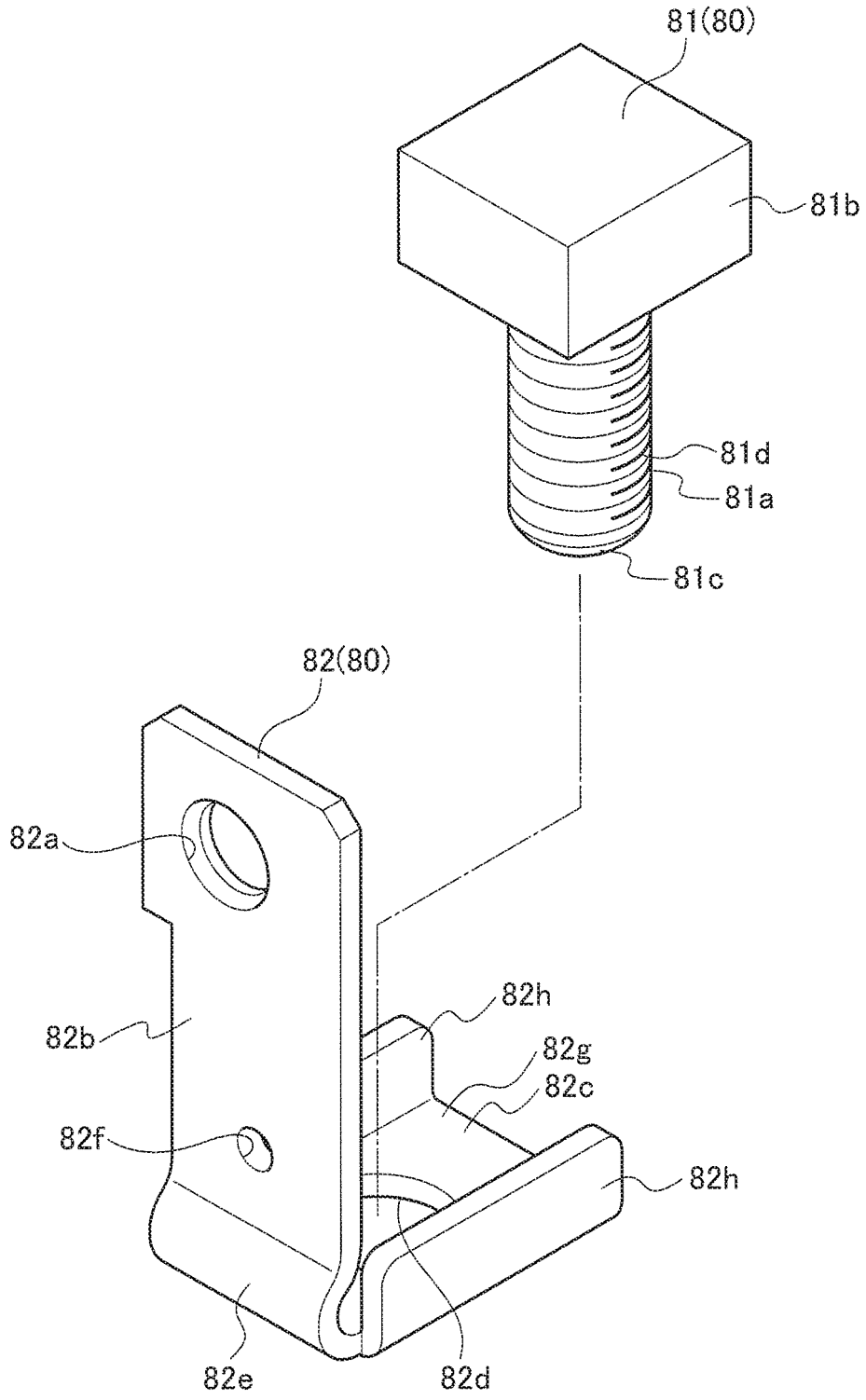
FIG. 7 is an exploded perspective view schematically showing a terminal portion according to the embodiment of the present invention.
Figure 8:
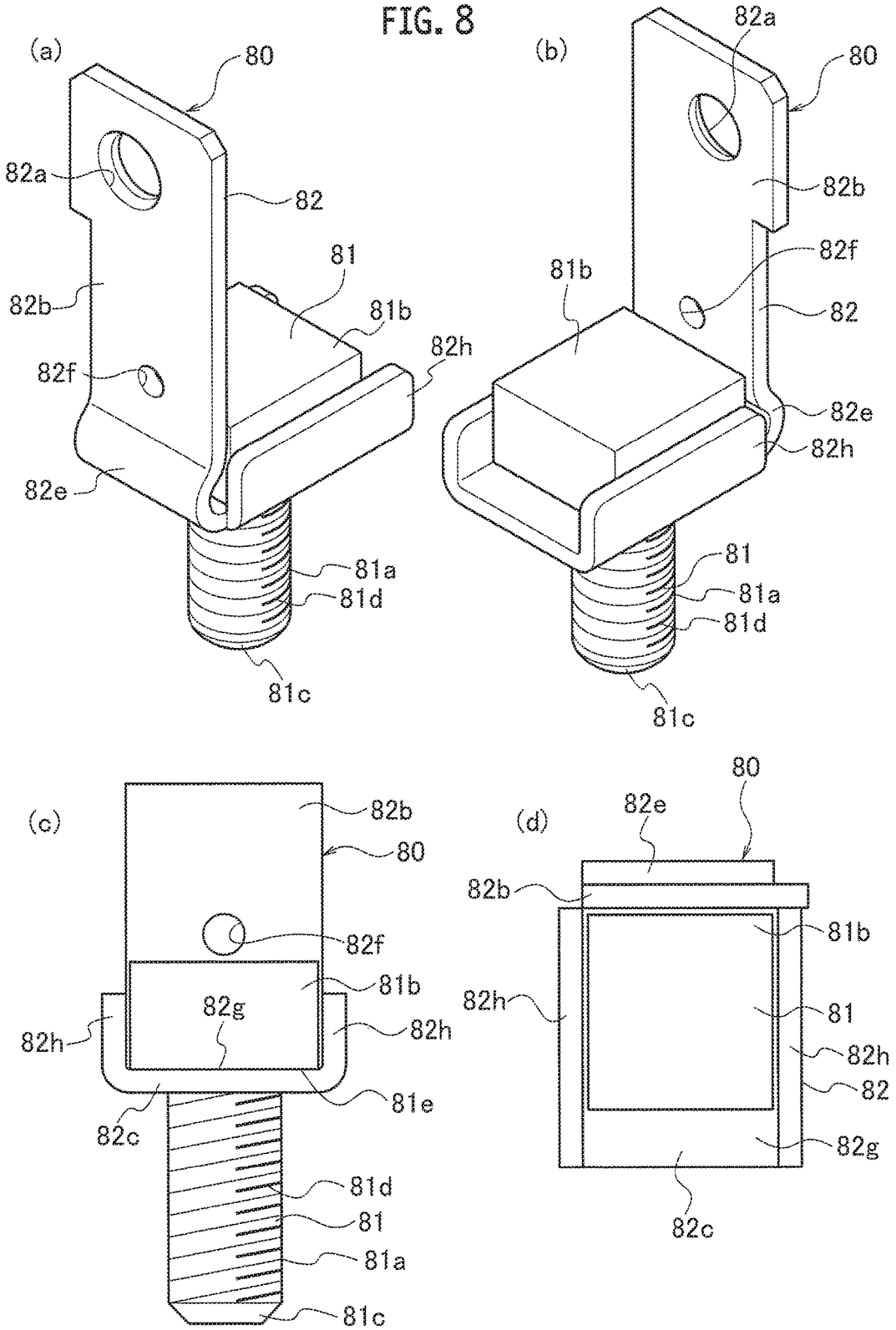
FIGS. 8(*a*) to 8(*d*) are views showing the terminal portion according to the embodiment of the present invention, FIG. 8(*a*) being a perspective view seen from one side, FIG. 8(*b*) being a perspective view seen from the other side, FIG. 8(*c*) being a front view and FIG. 8(*d*) being a plan view.

Therefore, in this embodiment, at least one of the outside terminal portion (first terminal portion) 81 and the inside terminal portion (second terminal portion) 82, i.e., the inside terminal portion 82 is provided with wall portions (rotation restriction portion) 82*h* for restricting relative rotation between the outside terminal portion 81 and the inside terminal portion 82 (see FIGS. 7 and 8).

To be more specific, the wall portions 82*h* are provided to extend to the side where the outside terminal portion 81 is inserted from both ends of the supporting plate 82*c* in the width direction. The head portion 81*b* of the outside terminal portion 81 is engaged with the wall portions 82*h* to stop the rotation of the outside terminal portion 81. More specifically, the wall portions (rotation restriction portion) 82*h* restrict the relative rotation between the outside terminal portion 81 and the inside terminal portion 82. Thus, in this embodiment, the rotation restriction portion has the wall portions 82*h* for restricting the relative rotation between the outside terminal portion 81 and the inside terminal portion 82 by engaging with the head portion 81*b* of the outside terminal portion 81.

The wall portions 82*h* are formed by bending both ends of the supporting plate 82*c*, and are formed continuously and integrally with the supporting plate 82*c*. Therefore, the inside terminal portion 82, including the wall portions 82*h*, is continuously and integrally formed by bending one plate. Since the terminal portions 80 and 80 are formed using a conductive metal material, all the wall portions 82*h* are also formed using a metal material. Here, it suffices that at least part of the wall portions (rotation restriction portion) 82*h* is made of a metal material.

Moreover, the shape and number of the wall portions can be appropriately set in accordance with the shape of the head portion 81*b*. When the head portion has a polygonal shape, for example, wall portions can be provided along the sides of the head portion. Here, the wall portions may be provided along all the sides of the head portion or may be provided along some of the sides. More specifically, the wall portions may have any shape as long as the shape can restrict the relative rotation between the outside terminal portion 81 and the inside terminal portion 82.

As described above, in this embodiment, the terminal portion 80 has the screw portion 81*a* exposed from the case (housing) 5. Therefore, the number of parts to be prepared by a user to fasten the counterpart member 90 to the terminal portion 80 can be reduced. More specifically, it has heretofore been required for the user to prepare screws and bolts in addition to the counterpart member 90 and the nut 91. However, the configuration of this embodiment eliminates the need for the user to prepare such screws and bolts. Moreover, the counterpart member (bus bar, harness, round terminal or the like) 90 can be fastened (connected) to the terminal portion 80 just by screwing the nut 91 onto the screw portion 81*a*. Thus, the counterpart member (bus bar, harness, round terminal or the like) 90 can be more easily fastened (connected) to the terminal portion 80.

Moreover, in this embodiment, the terminal portion 80 includes: the outside terminal portion (first terminal portion) 81 having the screw portion 81*a* formed thereon; and the inside terminal portion (second terminal portion) 82 connected to the outside terminal portion 81. That is, the terminal portion 80 includes more than one member. At least in a state where the counterpart member (bus bar, harness, round terminal or the like) 90 is fastened (connected) to the terminal portion 80, the outside terminal portion 81 and the inside terminal portion 82 are electrically connected to each other.

With such a configuration, versatile articles such as normal bolts can be used as the outside terminal portion first terminal portion) 81. More specifically, it is no longer required to newly prepare a terminal portion having a screw portion integrally formed thereon, and thus the number of processing steps can be reduced. Since the need to prepare additional members such as bolts and nuts is eliminated, the attachment process of the counterpart member 90 can be simplified.

Moreover, in this embodiment, at least one of the outside terminal portion (first terminal portion) 81 and the inside terminal portion (second terminal portion) 82 is provided with the wall portions (rotation restriction portion) 82*h* for restricting the relative rotation between the outside terminal portion 81 and the inside terminal portion 82.

Therefore, the outside terminal portion 81 can be suppressed from being rotated (co-rotated) with the nut 91 when the nut 91 is screwed onto the screw portion 81*a*. As a result, a jig for fixing the outside terminal portion 81 to prevent co-rotation thereof with the nut 91 is no longer required. At the same time, an operation of fixing the outside terminal portion 81 (head portion 81*b*) with such a jig can be omitted.

Thus, according to this embodiment, the electromagnetic relay 100 can be obtained, which can ensure attachment of the counterpart member 90 while simplifying the attachment process of the counterpart member 90.

Moreover, in this embodiment, the wall portions (rotation restriction portion) 82*h* are at least partially made of a metal material. Thus, the wall portions (rotation restriction portion) 82*h* are suppressed from being damaged by the head portion 81*b*. As a result, the counterpart member 90 can be more surely attached.

Moreover, the configuration of this embodiment enables the use of the outside terminal portion 81 with a different kind of screw. Thus, the electromagnetic relay 100 can have versatility.

Particularly, in this embodiment, the inside terminal portion 82 includes the connecting plate 82*b*, the connector 82*e* and the supporting plate 82*c*, and the connector 82*e* is configured to be elastically deformable. Thus, the supporting plate 82*c* can be rotated about the connector 82*e* relative to the connecting plate 82*b*. Therefore, the outside terminal portion 81 can be detached from the supporting plate 82*c* or supported on the supporting plate 82*c* in a state where the inside terminal portion 82 is connected to the fixed terminal 35. More specifically, the outside terminal portion 81 can be attached to and detached from the supporting plate 82*c* while leaving the inside terminal portion 82 connected to the fixed terminal 35. Such a configuration further facilitates replacement with the outside terminal portion 81 with a different kind of screw.

Although the dm embodiment of the present invention has been described above, the present invention is not limited to the above embodiment and various modifications can be made.

For example, a rotation restriction assisting portion 83 configured to assist restriction of relative rotation between the outside terminal portion 81 and the inside terminal portion 82 can be provided between a contact surface (contact portion: the surface of the head portion 81*b* on the shaft 81*c* side) 81*e* of the outside terminal portion 81 and a contact surface (contact portion: the surface of the supporting plate 82*c* facing the case base) 82*g* of the inside terminal portion 82, the contact surfaces 81*e* and 82*g* coming in contact with each other when the outside terminal portion (first terminal portion) 81 and the inside terminal portion (second terminal portion) 82 are electrically connected to each other. The rotation restriction assisting portion 83 as described above assists rotation restriction with an increase in engagement and frictional force. The rotation restriction assisting portion 83 can be obtained by forming an uneven shape or protrusion on the contact surface 81*e* or the contact surface 82*g* or by roughening the contact surface 81*e* or the contact surface 82*g*. Moreover, a part having viscosity or elasticity may be interposed between the contact surface 81*e* and the contact surface 82*g*. Such a part having viscosity or elasticity may be or may not be fixed to the contact surface 81*e* or the contact surface 82*g*.

Figure 11:
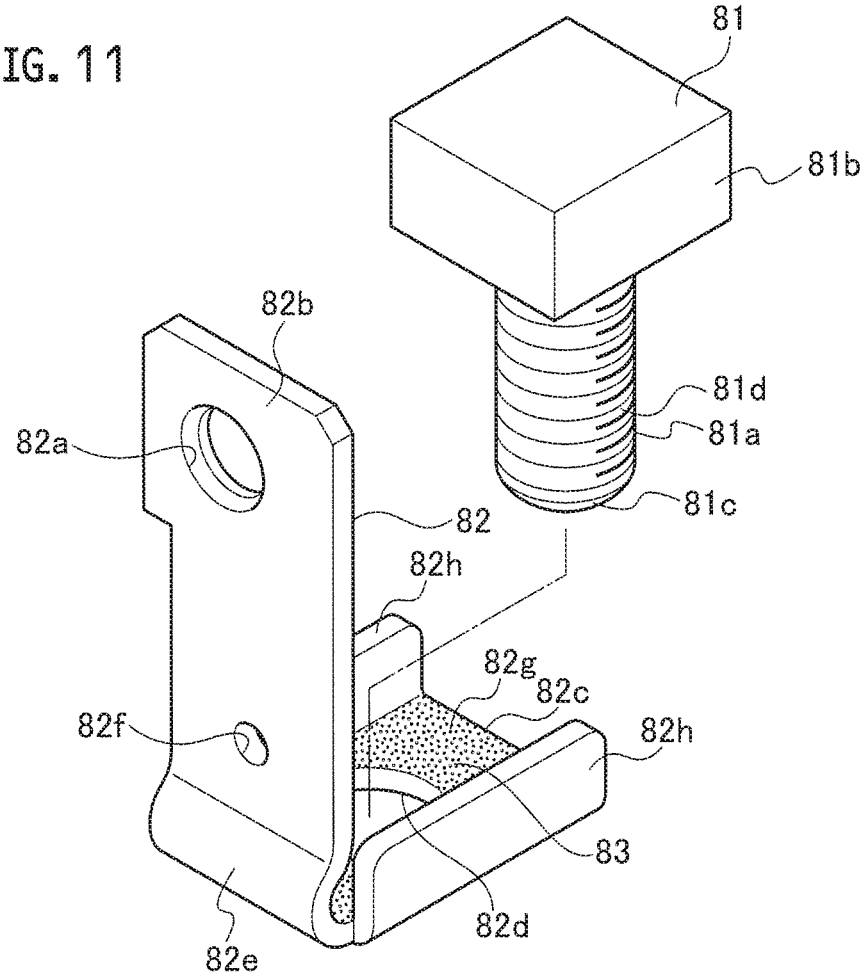
FIG. 11 is an exploded perspective view showing a modified example of the terminal portion according to the embodiment of the present invention.
Figure 12:
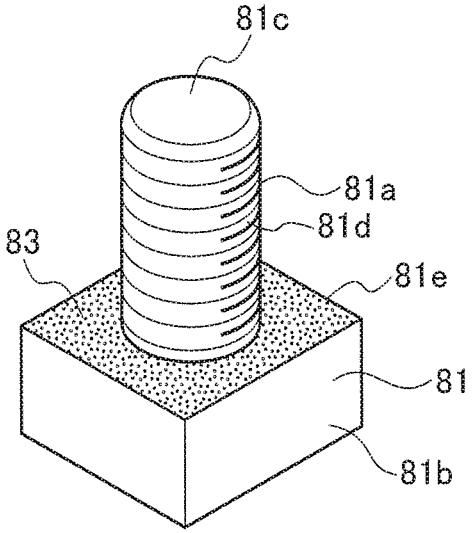
FIG. 12 is a perspective view showing another modified example of the terminal portion according to the embodiment of the present invention.

FIG. 11 shows an example where the rotation restriction assisting portion 83 is provided on the contact surface 82*g* of the inside terminal portion (second terminal portion) 82 with the outside terminal portion (first terminal portion) 81. On the other hand, FIG. 12 shows an example where the rotation restriction assisting portion 83 is provided on the contact surface 81*e* of the outside terminal portion (first terminal portion) 81 with the inside terminal portion (second terminal portion) 82. Note that the rotation restriction assisting portion 83 may be provided on both of the contact surface 81*e* of the outside terminal portion (first terminal portion) 81 and the contact surface 82*g* of the inside terminal portion (second terminal portion) 82.

Here, it suffices that the rotation restriction assisting portion is provided in a contact portion at which the outside terminal portion (first terminal portion) 81 and the inside terminal portion (second terminal portion) 82 are electrically connected to each other. For example, the rotation restriction assisting member may be provided between the inside surface of the wall portions 82*h* and the outside surface of the head portion 81*b*. Here, the rotation restriction assisting member may also be provided in the rotation restriction portion itself.

Moreover, although the above embodiment and the modified example thereof show the one in which the terminal portion includes two parts, the terminal portion may include three or more parts.

Moreover, although the above embodiment and the modified example thereof show the one in which the rotation restriction portion is provided on the second terminal portion, the rotation restriction portion may be provided on the first terminal portion or may be provided on both of the first terminal portion and the second terminal portion.

Furthermore, specifications (shape, size, layout and the like) of the terminal portion, the second terminal portion and the other details can also be appropriately changed.

INDUSTRIAL APPLICABILITY

According to the present invention, an electromagnetic relay can be obtained, which is capable of ensuring attachment of the counterpart member while simplifying the attachment process of the counterpart member.

The invention claimed is:

1. An electromagnetic relay comprising:

a contact device including a fixed terminal with a fixed contact formed, and a movable contactor with a movable contact formed to come into contact with and separate from the fixed contact;

a housing storing the contact device therein; and a terminal portion including a screw portion directed outward from the housing and exposed from the housing, the terminal portion is connected to the contact device, while a counterpart member is connected to the terminal portion, wherein the terminal portion includes a first terminal portion where the screw portion is formed, and a second terminal portion connected to the first terminal portion, the terminal portion is electrically connected to the movable contact and the fixed contact in a state where the movable contact comes in contact with the fixed contact, the first terminal portion and the second terminal portion are electrically connected to each other at least in a state where the counterpart member is connected to the terminal portion, a rotation restriction portion configured to restrict relative rotation between the first terminal portion and the second terminal portion is provided on at least one of the first terminal portion and the second terminal portion, the first terminal portion and the second terminal portion are capable of independent movement relative to one another, the first terminal portion includes a head portion and a shaft portion connected to the head portion, and the shaft portion is provided with the screw portion, the second terminal portion includes a support portion in which an insertion hole through which the shaft portion is inserted is formed, and the head portion of the first terminal portion is disposed between the housing and the support portion of the second terminal portion.

2. The electromagnetic relay according to claim 1, wherein the rotation restriction portion is at least partially made of a metal material.

3. The electromagnetic relay according to claim 1, wherein the first terminal portion includes a bolt having a polygonal head portion, and the rotation restriction portion has a wall portion provided on the second terminal portion and engaged with the head portion.

4. The electromagnetic relay according to claim 1, wherein when the first terminal portion and the second terminal portion are electrically connected to each other, a contact portion of the first terminal portion and a contact portion of the second terminal portion come into contact with each other, and a rotation restriction assisting member configured to assist restriction of relative rotation between the first terminal portion and the second terminal portion is provided between the contact portions of the first and second terminal portions.

5. The electromagnetic relay according to claim 1, wherein in a state where the counterpart member is not connected to the terminal portion, the first terminal portion is supported by the second terminal portion in a state that the first terminal portion is independently movable relative to the second terminal portion.

6. The electromagnetic relay according to claim 1, wherein in a state where the counterpart member is not connected to the terminal portion, the second terminal portion is fixed to the housing.

* * * * *